United States Patent [19]

Uhl et al.

[11] 3,979,113

[45] Sept. 7, 1976

[54] BICYCLE EXERCISING APPARATUS

[76] Inventors: Gerald A. Uhl, 35271 Drakeshire Place, Apt. 203, Farmington, Mich. 48024; Johannes J. M. Pennock, 1815 E. Lincoln, Birmingham, Mich. 48008

[22] Filed: Jan. 28, 1975

[21] Appl. No.: 544,745

[52] U.S. Cl. ..... 272/73; 280/289 R

[51] Int. Cl.[2] ..... A63B 21/00

[58] Field of Search ..... 272/73, 79, 1 B, DIG. 5, 272/DIG. 3; 128/25 R; 280/3, 289; 235/103, 103.5 R; 350/97, 99, 103; 46/175 R, 175 AR

[56] References Cited

UNITED STATES PATENTS

| | | | |
|---|---|---|---|
| 587,302 | 8/1897 | Dorchester | 235/103.5 R |
| 2,198,058 | 4/1940 | Mobeck | 272/73 |
| 2,783,044 | 2/1957 | Sbarra | 272/73 X |
| 2,914,886 | 12/1959 | Barthel | 46/175 R |
| 3,091,209 | 5/1963 | Leiberman | 272/1 B |
| 3,895,855 | 7/1975 | Nagel | 350/97 |

*Primary Examiner*—Richard C. Pinkham
*Assistant Examiner*—T. Brown
*Attorney, Agent, or Firm*—Harness, Dickey & Pierce

[57] ABSTRACT

A exercising apparatus attachment is disclosed as comprising one or more air deflector devices that are adapted to be mounted on the driven rotatable wheel of an operator propelled device, such as the spokes of the wheel(s) of a bicycle, for increasing the resistance to rotation of the wheel and hence provide an exercising function for the vehicle operator. The attachment includes a pair of planar deflector sections interconnected by an intermediate web section arranged generally perpendicular to the plane of the sections and one of the deflector sections includes a plurality of deflector portions that are separated from one another in a radial direction relative to the axis of the wheel to which the deflector is attached.

1 Claim, 6 Drawing Figures

BICYCLE EXERCISING APPARATUS

SUMMARY OF THE INVENTION

Various types of devices have heretofore been proposed for converting a conventional two-wheeled bicycle into an apparatus for providing exercise for the bicycle operator. Such devices have included stands for mounting the rear and/or front wheels of the bicycle in an elevated position to permit pedalling of the bicycle in a stationary attitude. In those instances where resistance to rotational movement of the pedalled or driven wheel of the bicycle was desired, friction boxes or other means for engaging the driven bicycle tire have been utilized.

The various apparatus heretofore known and used have been objectionable for a number of reasons, relating primarily to the expense thereof, the dificulty for mounting and dismounting the bicycle from its support stands and the objectionable attrition due to ancillary friction creating means, i.e. roller, etc., coming into engagement with the vehicle tire. Virtually all of such prior art devices have been relatively elaborate and of a cumbersome nature, being difficult to assemble and/or awkward to use. Many other of such devices have lacked versatility in being adapted for use with only one or two models of bicycle frame styles and hence have lacked universality of application.

The present invention provides a new and improved bicycle exercising device which is intended to overcome the various objectionable features of similar type devices heretofore known in the art. More particularly the present invention provides a new and improved bicycle exercising device which utilizes one or more air deflectors mounted on the rotatable or driven wheel of a bicycle for creating resistance to rotation and thereby providing the exercising function. The air deflectors may be utilized during normal use of the bicycle and thereby provide the exercising function by causing the bicycle operator to exert himself to a greater degree than would be necessary without the use of the air deflectors. Alternatively, the apparatus may be combined with a support standard arrangement for elevating the bicycle and thereby permitting use thereof in a stationary position in order to achieve the desired exercising function.

It is accordingly a general object of the present invention to provide a new and improved bicycle exercising device.

It is a more particular object of the present invention to provide a new and improved bicycle exercising device which utilizes one or more air deflectors mounted on and rotatable with one of the wheels of the bicycle for creating resistance to rotation thereof.

It is yet another object of the present invention to provide a new and improved apparatus of the above described type which may be utilized during normal use of a bicycle or when the bicycle is mounted in a stationary position.

It is another object of the present invention to provide a new and improved bicycle exercising device incorporating at least one air deflector, but which may include a multiplicity of such deflectors, depending upon the degree of exercise to which the bicycle operator wants to be subjected.

It is still another object of the present invention to provide a new and improved exercising device which is of a relatively simple design, is economical to manufacture and will have a long and effective operational life.

It is still a further object of the present invention to provide a new and improved bicycle exercising device that may be conveniently attached to a bicycle.

Other objects and advantages of the present invention will become apparent from the following detailed description taken in conjunction with the accompanying drawing.

DETAILED DESCRIPTION OF THE PREFERRED EMBODIMENTS

Figures 1, 2, 3, 4, 5, 6:
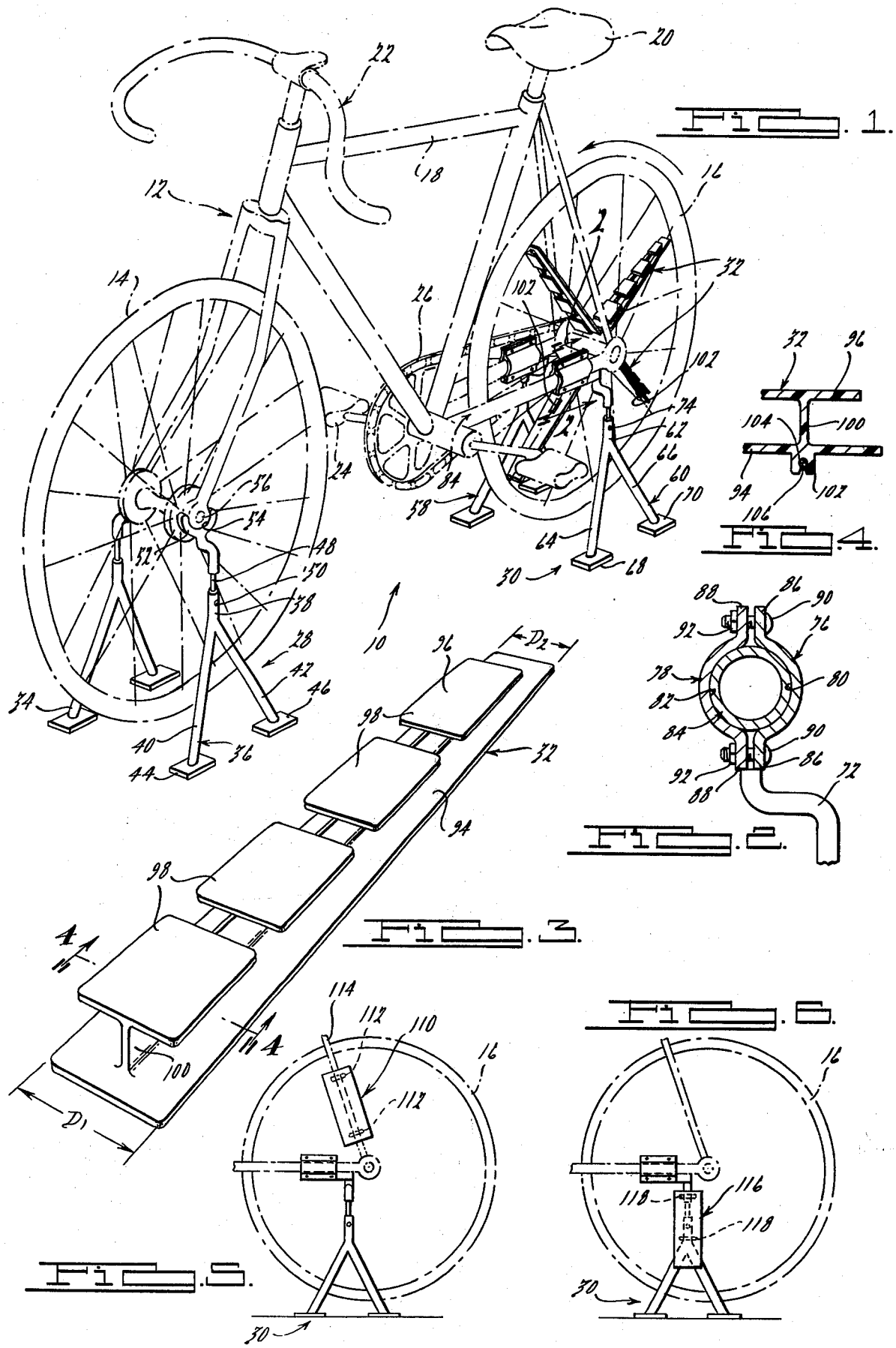
FIG. 1 is an elevated perspective view of the bicycle exercising device of the present invention as shown in operative association with a typical two-wheeled bicycle.
FIG. 2 is an enlarged transverse cross sectional view taken substantially along the line 2—2 of FIG. 1.
FIG. 3 is an elevated perspective view of one of the air deflectors incorporated in the exercise apparatus of the present invention.
FIG. 4 is a transverse cross sectional view taken substantially along the line 4—4 of FIG. 3.
FIG. 5 is a side elevational view of an alternate embodiment of the exercising device of the present invention.
FIG. 6 is a view similar to FIG. 5 and illustrates still another embodiment of the exercising device of the present invention.

Referring now to FIG. 1 of the drawing, a bicycle exercising apparatus is generally designated by the numeral 10 and is shown in operative association with a conventional two-wheeled operator propelled vehicle or bicycle 12 comprising front and rear rotatable wheels 14 and 16, respectively, that are mounted upon a chassis or frame 18. The frame 18 is provided with an operator seat 20 and with steering or handle bars 22 that are operatively connected to the front steerable wheel 14 in a conventional manner. Disposed below the seat 20 is a foot operated pedal mechanism 24 which is drivingly connected via a suitable drive chain 26 with the rear or driven wheel 16 of the bicycle 12. As is well known in the art, upon proper rotation of the pedal mechanism 24, the rear wheel will be rotated, thereby propelling the bicycle 12 along any suitable support surface.

Referring now in detail to the exercising apparatus 10, said apparatus includes front and rear support stand assemblies 28 and 30, respectively, which are operatively associated with the front and rear wheels 14 and 16, respectively, of the bicycle 12. Additionally, the apparatus 10 of the present invention comprises one or more air deflector assemblies, generally designated by the numeral 32, which are operatively mounted upon the rear or driven wheel 16 of the bicycle 12 and function to create air resistance upon rotation of the wheel 16, whereby to increase the resistance to rotation of the wheel 16 and hence provide the desired exercising function, as compared to having the wheel 16 freely rotate upon rotation of the pedal mechanism 24, as will hereinafter be described in detail.

The front support stand assembly 28 comprises right and left support standards 34 and 36, respectively, which are preferably identical in construction and comprise generally tubular frames 38 having diverging lower legs 40 and 42 that are provided with support pads 44 and 46, respectively, on the lower ends thereof. The upper ends of the support standards 34, 36 are provided with vertically adjustable members 48 which may be telescopically received within the frames 38 and be provided with a suitable set of locking screws 50 to provide for selective vertical adjustment thereof. The upper ends of the adjustable members 48 are provided with bifurcated clevis sections 52 defining recesses 54 adapted to have the opposite ends of the front wheel hub or axle received therein. If desired, suitable retaining means such as an ancillary threaded nut may be threadably received on the opposite ends of the axle of the front wheel 14 for fixedly securing the same upon the upper ends of the support standards 34, 36. In practice, the adjustable members 48 of the standards 34, 36 are vertically adjusted such that the front wheel 14 is slightly above the support surface upon which the pads 44, 46 rest, as will be described.

With reference now to the rear support standard assembly 30, as best seen in FIG. 1, said assembly comprises right and left support standards 58 and 60, respectively, which are provided with tubular frame 62 identical or similar to the aforementioned frames 38 of the front assemblies 28 and as such, comprise diverging legs 64, 66 having support pads 68, 70, respectively, on the lower ends thereof. The upper ends of the frames 62 are provided with vertically adjustable members 72 which may be selectively vertically secured relative to the frames 62 by means of suitable setscrews or the like 74. As best seen in FIG. 2, the upper ends of the adjustable members 72 are provided with pairs of clamping plates 76 and 78 which define semicircular recesses 80, 82, respectively, and adapted to be clampingly secured to the opposite sides of the generally horizontally disposed frame sections 84 of the bicycle 12. The clamping plates 76, 78 are provided with edge flanges 86, 88 through which suitable screws, bolts or the like 90 extend that are cooperable with threaded nuts 92 for clampingly securing the plates 76, 78 to the frame sections 84. The purpose of the clamping plates 76, 78 is to secure the support standards 58, 60 to the bicycle 12 at longitudinally spaced locations, whereby to prevent fore and aft rocking or movement of the bicycle 12 upon pedalling or operation thereof. Thus, the arrangement wherein the support standards 58, 60 are secured to the frame section 84 at longitudinally spaced positions significantly increases the stability of the bicycle 12 when it is supported upon the standard assemblies 28, 30. In practice, the adjustable members 72 of the support standards 58, 60 are vertically adjusted relative to the frames 62 thereof such that rear wheel 16 of the bicycle 12 is spaced somewhat above the surface upon which the pads 68, 70 rest. Preferably, the adjustable members 72 of the support standards 58, 60 are adjusted relative to the adjustable members 48 of the support standards 34, 36 such that the bicycle 12 is supported in a generally horizontal or level position with the front and rear wheels 14, 16 being spaced approximately the same distance above the support surface upon which the pads 44, 46, 68 and 70 rest.

Referring now in detail to the construction and operation of the air deflector assembly 32 incorporated in the exercising apparatus 10 of the present invention, as best seen in FIG. 3, said assembly 32 comprises a pair of spaced parallel air deflector vanes or sections 94 and 96, the latter of which is in the form of a plurality of spaced-apart deflector portions or segments, generally designated by the numeral 98. The sections 94, 96 are connected by an intermediate web section 100 which lies in a plane transverse or perpendicular to the sections 94, 96. It is contemplated that the assembly 32 be fabricated of a molded plastic material and as such the assembly 32 would be of a one-piece monolithic construction, with the sections 94, 96 and 100 being integrally connected to one another. It is also contemplated that the assembly 32 will have a maximum width at one end thereof, as indicated by the dimension $D_1$ in FIG. 3, and be tapered or become narrower toward the opposite end thereof to a width of $D_2$. The dimensions $D_1$ and $D_2$ are intended to correspond with the decrease in cross sectional thickness of the bicycle wheel 16 between the axle or hub thereof and the tire rim thereof, as is well known in the art. Regardless of the specific dimensions of the assembly 32, it is important that the dimensions $D_1$ and $D_2$ not be significantly greater than the cross sectional thickness of the wheel at the hub and rim, respectively, thereof so as to not interfere with the support frame 18 of the bicycle 12 during rotation of the assembly 32 with the wheel 16.

In operation of the assembly 32, it is contemplated that the assembly 32 will be mounted directly on the spokes of the rear wheel 16 of the bicycle 12 in the manner best shown in FIG. 1. Toward this end the underside of the deflector section 94 is preferably provided with one or more integral clips, best seen in FIG. 4 and designated by the numeral 102. The clips 102 are formed with an internal semicircular recess 104 adapted to removably receive one of the bicycle wheel spokes, representatively designated by the numeral 106 in FIG. 4. Thus, the assembly 32 may be mounted directly on the spokes of the rear wheel, but may be removed therefrom when it is desired to operate the bicycle 12 without the apparatus 10 of the present invention. It is to be noted that optimum use of the assembly 32 has been found when the deflector section 96 is on the forward or leading side of the apparatus 32 as the same rotates, for example in the direction of the arrow in FIG.1; however, the scope of the present invention is not intended to be limited to so orienting the apparatus 32.

Although it has been found that one of the apparatus or deflectors 32 mounted on the rear wheel 16 of the bicycle 12 operates satisfactorily to provide a resistance to rotation of the wheels 16, it is contemplated to provide two or more of such deflectors 32 and as such, FIG. 1 illustrates the use of four equally circumferentially spaced deflectors 32 on the wheel 16 so that an even greater amount of air resistance is created, thereby providing for a greater degree of exercise for the operator pedalling the bicycle 12. It will be appreciated, of course, that a greater number than four of the apparatus 32 can be used where an even greater degree of resistance to rotation is desired, and likewise, if a lesser amount of resistance to rotation of the wheel 16 is desired, the number of apparatus 32 can be reduced accordingly.

With reference to FIG. 5, it has been found that an even greater degree of resistance to rotation of the wheel 16 will occur when a relatively fixed air deflector is located adjacent the wheel 16 so as to cooperate with the one or more of the deflectors 32 which rotates with the wheel 16. Toward this end, it is contemplated that a deflector or baffle 110 may be mounted upon the frame section 114 of the bicycle and be secured thereto by suitable retaining clips or the like 112. The baffle 110 may be mounted on just one side of the bicycle 12 or a pair of such baffles 110 may be mounted on the opposite sides of the bicycle 12 and be detachably secured to the frame members 114 thereon. Alternatively, and as best seen in FIG. 6, a fixed baffle, as designated by the numeral 116, may be secured by suitable retaining clips or the like 118 to one or both of the rear support standards 58 and/or 60. Such baffles 112 and 116 may be of relatively planar configuration and be arranged generally transversely to the rotational axis or such baffles may be of a relatively concave or convex configuration, as desired.

It is to be noted that while the present invention is shown as incorporating the support standard assemblies 28, 30, the scope of the present invention is not intended to be limited specifically to the use of such assemblies 28, 30, since one or more of the deflector assemblies 32 may be utilized during normal use of the bicycle 12 so as to increase the resistance to rotation of the rear wheel 16 thereof and hence provide for the desired exercising function. Additionally, it is to be noted that it may not be necessary to utilize the front support assembly 28, but instead, use only the rear support assembly 30 to elevate the rear wheel 16 above the adjacent support surface, with the front wheel 14 of the bicycle 12 resting directly upon such surface. It is further to be noted that the deflector assemblies 32 may be fabricated of a suitable material so as to provide for light reflection and thereby provide a safety feature when the bicycle operator is using the bicycle 12 during periods of low available light.

While it will be apparent that the preferred embodiments illustrated herein are well calculated to fulfill the objects above stated, it will be appreciated that the presnet invention is susceptible to modification, variation and change without departing from the scope of the invention.

We claim:

1. An exercise device for use with a rotatable spoke-type wheel of an operator propelled vehicle, said device including at least one air deflector rotatable with the wheel for increasing the resistance to rotation thereof, and means cooperable with the spokes of the wheel supporting said deflector at a position extending generally radially between the center of rotation of the wheel and the outer periphery thereof, said deflector comprising a monolithic structure fabricated of a molded polymeric material and including first and second deflector sections that are interconnected by an intermediate web section arranged generally perpendicular to the plane of said deflector sections, one of said deflector sections comprising a plurality of deflector portions that are separated from one another in a radial direction relative to the axis of said wheel.

* * * * *